US005335888A

United States Patent [19]

Thomsen

[11] Patent Number: 5,335,888

[45] Date of Patent: Aug. 9, 1994

[54] FOREARM SUPPORT CRADLE

[76] Inventor: Terry H. Thomsen, 200 Duncaster Rd., Bloomfield, Conn. 06002

[21] Appl. No.: 920,262

[22] Filed: Jul. 27, 1992

[51] Int. Cl.[5] ..... B43L 15/00

[52] U.S. Cl. ..... 248/118.5; 248/118.1; 248/205.2; 2/16

[58] Field of Search ..... 248/118, 118.1, 118.3, 248/118.5, 205.2, 918; 128/877, 878, 879, DIG. 6; 400/715; 2/2, 16, 22, 24

[56] References Cited

U.S. PATENT DOCUMENTS

| | | | |
|---|---|---|---|
| 8,065 | 4/1851 | Goshen | 248/118.5 |
| 188,984 | 3/1877 | Taylor | 248/118.5 X |
| 226,411 | 4/1880 | McElroy | 248/118.5 |
| 1,510,877 | 10/1924 | Wiedenmann | 248/118.5 |
| 2,363,058 | 11/1944 | Gill | 2/24 |
| 2,552,177 | 5/1951 | Hurt | 2/24 |
| 4,150,422 | 4/1979 | Boone | 2/24 X |
| 4,198,708 | 4/1980 | Fugere et al. | 2/16 |
| 4,259,949 | 4/1981 | Axelsson | 248/118 X |
| 4,482,063 | 3/1991 | Berke | 248/118 X |
| 4,621,781 | 11/1986 | Springer | 248/118 |
| 4,756,026 | 7/1988 | Pierce, Jr. | 2/16 |
| 4,757,555 | 7/1988 | Gold | 2/16 |
| 4,784,120 | 11/1988 | Thomas | 248/118 X |
| 4,822,103 | 4/1989 | Stenvall | 248/118 X |
| 4,862,904 | 9/1989 | West et al. | 128/877 |
| 4,941,480 | 7/1990 | McLean et al. | 128/879 X |
| 4,996,977 | 3/1991 | Tiedeken | 248/118 X |
| 5,040,757 | 8/1991 | Benaway | 248/118.3 |
| 5,056,743 | 10/1991 | Zwar et al. | 248/118 |
| 5,072,905 | 12/1991 | Hyatt | 248/118 |
| 5,081,715 | 1/1991 | Mascia | 2/20 |
| 5,104,073 | 4/1992 | VanBeek et al. | 248/118.3 |

FOREIGN PATENT DOCUMENTS

| | | | |
|---|---|---|---|
| 57540 | 7/1891 | Fed. Rep. of Germany | 248/118.5 |
| 190397 | 12/1907 | Fed. Rep. of Germany | 248/118.3 |

OTHER PUBLICATIONS

Advertisement—AliMed Inc., Publication #322, May 1991-86.5 "AliMed Keyboard Wristrest".

*Primary Examiner*—Richard K. Seidel
*Assistant Examiner*—Clark F. Dexter
*Attorney, Agent, or Firm*—Chilton, Alix & Van Kirk

[57] ABSTRACT

A cradle for supporting the forearm of a computer operator above a work surface as the operator's hand and forearm are moved across the work surface for operating a computer mouse, the cradle having an elongated body of resilient foam with a longitudinally extending trough and an outer elastic sleeve extending around the elongated body and across the trough to form therewith an open channel for receiving, supporting and elevating the forearm above the work surface and for maintaining the operator's hand in a neutral position over a computer mouse for operating the mouse without abnormal cocking and hyperextension of the wrist, the sleeve providing a bottom surface adapted to glide across the work surface so that the cradle is retained under the forearm and is moved by and with the forearm as the operator's hand and forearm are moved across the work surface.

8 Claims, 2 Drawing Sheets

FOREARM SUPPORT CRADLE

BACKGROUND OF THE INVENTION

The present invention relates to ergonomic arm and wrist supports for preventing misuse or overuse of certain muscles and nerves while performing computer input operations and relates more particularly to a new and improved ergonomic support for supporting and positioning a computer mouse operator's forearm to prevent misuse and injury of certain nerves and tendons in the wrist and forearm while the operator's hand and forearm are moved to operate a computer mouse.

The most prevalent type of computer mouse is operated by manually moving the mouse back and forth across a work surface and "clicking" or actuating one or more switch buttons on the mouse at selected mouse positions. The operator's hand and forearm are moved across the work surface while performing such computer mouse operations. In some computer jobs and applications, a computer mouse is operated for extended periods of time, causing certain nerves and tendons in the wrist and forearm to be injured or inflamed. Carpal tunnel, ulnar nerve inflammation and tendonitis are directly linked to such computer mouse operation.

SUMMARY OF THE INVENTION

A principal object of the present invention is to provide a new and improved ergonomic support for a computer mouse operator for supporting the operator's forearm while the operator's hand and forearm are moved across the work surface to operate a computer mouse.

Another object of the present invention is to provide a new and improved ergonomic support for a computer mouse operator which provides a cushioned support for the forearm and wrist.

A further object of the invention is to provide a new and improved ergonomic support for a computer mouse operator which supports the weight of the forearm and cushions the forearm and wrist against engagement with the hard work surface while the operator's hand and forearm are moved across the work surface.

Another object of the present invention is to provide a new and improved ergonomic support which is comfortable to use and which can be attached to the forearm of the user or left on the work surface for use on a standby or as needed basis.

Another object of the present invention is to provide a new and improved ergonomic support for the forearm of a computer mouse operator which is moved with and by the forearm as the operator's hand and forearm are moved across a work surface to operate a computer mouse.

Other objects will be in part obvious and in part pointed out more in detail hereinafter.

A better understanding of the invention will be obtained from the following detailed description and the accompanying drawings of an illustrative application of the invention.

DESCRIPTION OF PREFERRED EMBODIMENT

Figure 7:
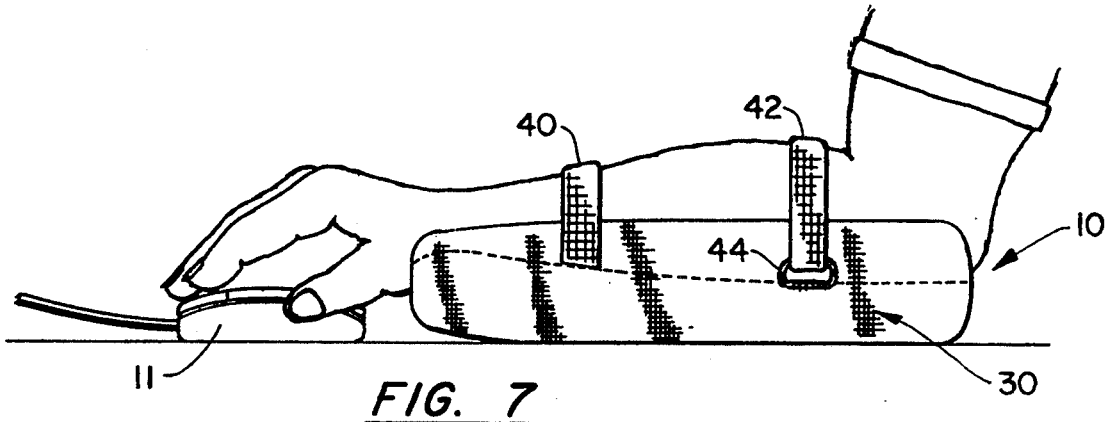
FIG. 7 is an elevation view, partly broken away, showing the cradle in its normal operating position under the forearm of a computer mouse operator.

The drawings disclose a forearm support cradle 10 incorporating a preferred embodiment of the present invention. The cradle 10 is designed to receive and support the wrist and forearm of a computer mouse operator as shown in FIG. 7. The wrist and forearm are supported above the work surface so that the operator's hand is elevated to extend over the top of a computer mouse 11. The cradle 10 remains under the wrist and forearm, supports the full weight of the operator's forearm and hand as desired and is moved by and with the forearm while the operator's hand and forearm are moved across the work surface.

The cradle 10 has an elongated internal body 12 and an outer fabric cover 14. The body 12 is preferably made of a suitable, low density urethane foam or other non-rigid foam which is both light and resilient. The elongated body 12 is preferably made from a block of foam material, for example a block 12 inches long, 5 inches wide and 2½ inches high. A 12 inch long body 12 will accommodate the average length forearm but the body 12 can be made longer or shorter as desired. The body 12 has a contoured top for snugly supporting the forearm and for retaining the cradle under the forearm as the operator's hand and forearm are moved across a work surface. Otherwise, the body 12 as formed, has a box shape with a flat bottom, flat parallel sidewalls and flat parallel, front and rear end walls.

Figure 8:
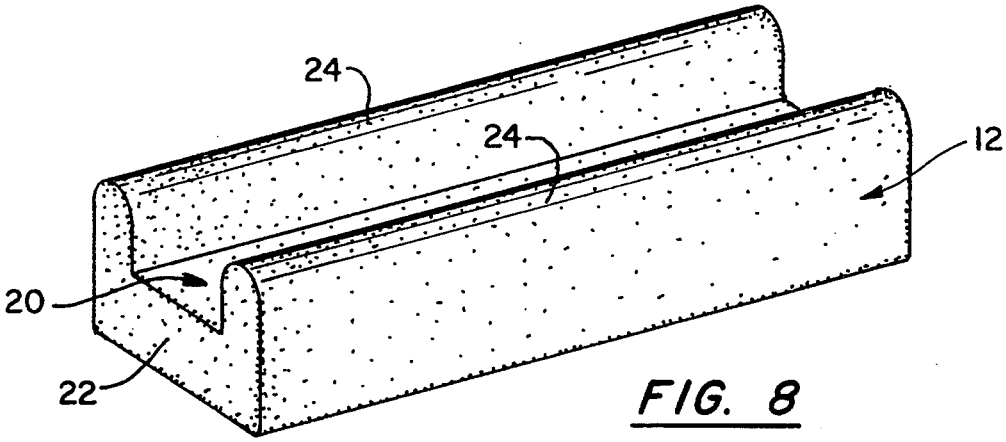
FIG. 8 is an isometric view of a resilient foam body of the cradle, showing the foam body in a relaxed condition thereof.
Figure 9:
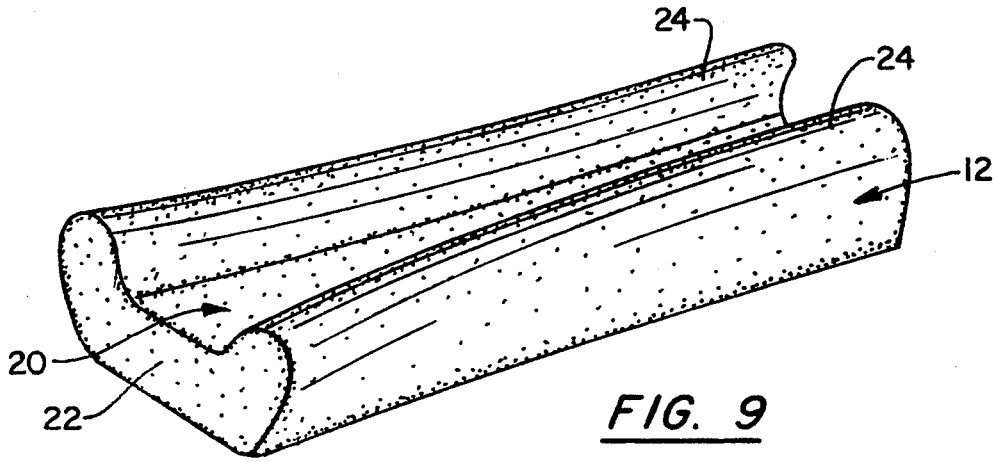
FIG. 9 is an isometric view of the resilient foam body, showing the foam body as it may be custom formed within an outer fabric cover of the cradle.

The contoured top of the body 12 provides a longitudinally extending trough 20 having a central flat base 22 and a raised edge 24 on each side of the base 22. The top contour, with the outer cover 14 removed, has the same transverse shape along its entire length as shown in FIG. 8. That transverse shape is symmetrical relative to the longitudinal centerline of the body 12 so that the body 12 is equally useful with left and right forearms.

The central recessed base 22 is for example one inch thick and provides a resilient support cushion for the wrist and for the forearm from the wrist to the elbow. The base 22 elevates the forearm so that the hand extends easily over the top of a computer mouse for operation of the mouse without abnormal cocking of the wrist or hyperextension of the nerves and tendons in the wrist area. The wrist and elbow are used as pivot points during mouse operation. The foam body 12 protects those two vulnerable areas against engagement with the hard work surface to prevent shock and other undesirable forces on the nerves and tendons in those areas.

The outer fabric cover 14 is made from a suitable, slippery, stretch fabric such as nylon lycra spandex and is formed as an elongated bag 30. The bag 30 is made from two identical pieces of fabric which are sewn together along the sides and across the front of the bag 30. The bag 30 has a rear opening and rear drawstring 32 which permit the bag 30 to be easily removed for cleaning and/or replacement. An elongated intermediate sleeve portion 34 of the bag 30 surrounds the foam body 12. The front end of the bag 30 encloses the front end of the body 12. The rear end of the bag 30 encloses the rear end of the body 12 when the drawstring 32 is tightened.

The intermediate sleeve 34 has an unstretched transverse circumference (e.g., 12 inches) which is somewhat less than the transverse circumference (e.g., 15 inches ) of the uncompressed foam body 12. Thus, in their assembled condition, the outer elastic sleeve 34 is stretched slightly by the foam body 12 and the inner resilient body 12 is compressed slightly by the outer sleeve 34. This confinement and compression of the inner body 12 within the outer sleeve 34 permits the inner body trough 20 to be custom formed to conform to the user's wrist and forearm. Preferably, the side edges 24 are spread apart at the forward end of the body 12 to accommodate the user's wrist and are drawn together by the drawstring 32 at the rear end of the body 12 to snugly receive the user's elbow.

Figure 1:
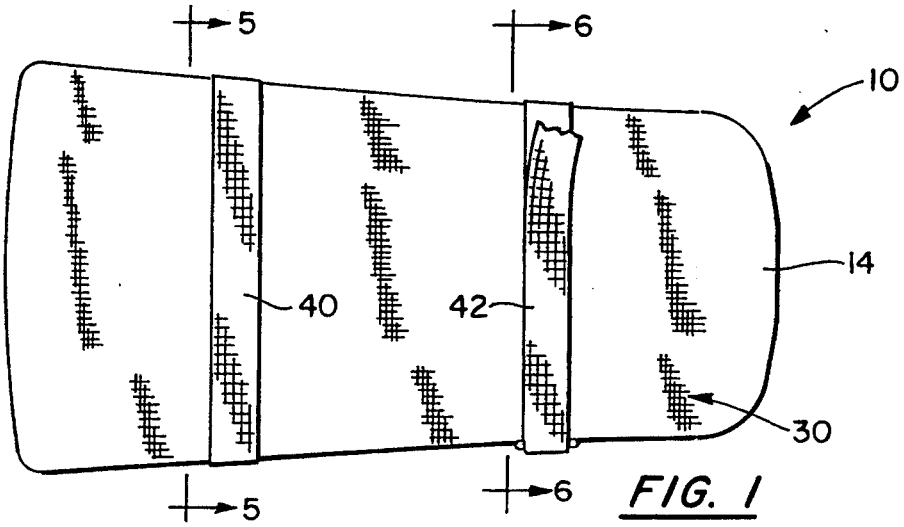
FIG. 1 is a top plan view, partly broken away, of a forearm support cradle incorporating an embodiment of the present inventions.
Figure 2:
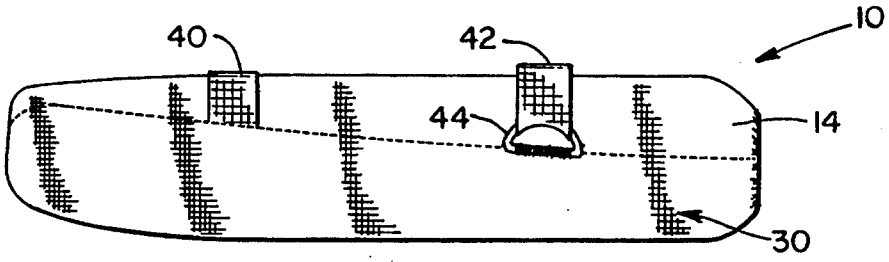
FIG. 2 is a side elevation view of the cradle.
Figure 3:
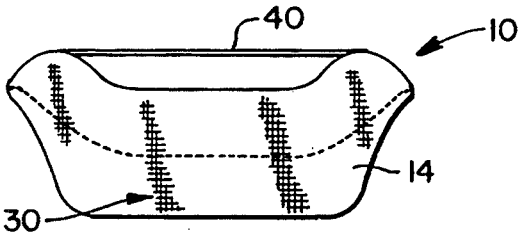
FIG. 3 is a front end view of the cradle.
Figure 4:
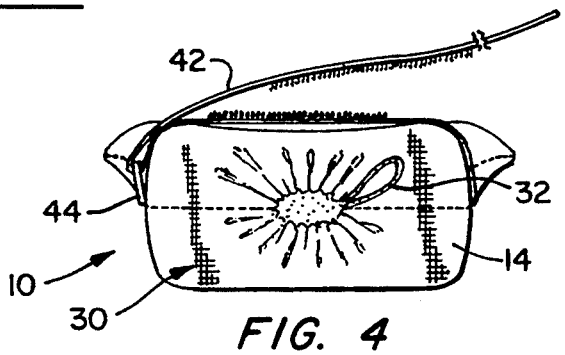
FIG. 4 is a rear end view, partly broken away, of the cradle.
Figure 5:
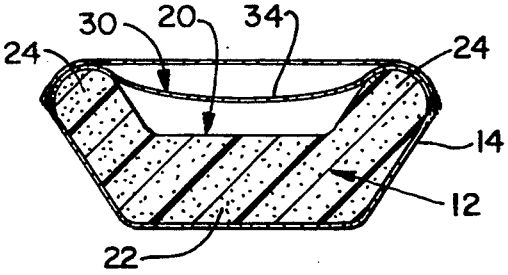
FIGS. 5 and 6 are transverse section views, partly in section, of the cradle, taken substantially along lines 5—5 and 6—6 respectively of FIG. 1.
Figure 6:
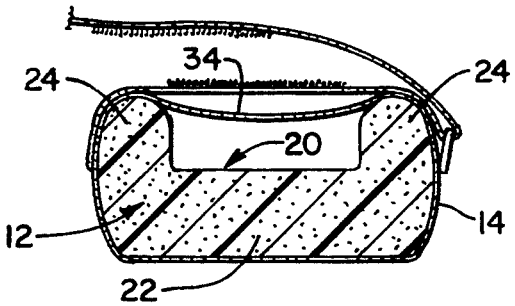

The intermediate sleeve 34 is suspended between the raised side edges 24 of the body 12 as shown in FIGS. 5 and 6. A concave fabric support is thereby formed above the recessed base 22 of the trough 20. Because the elongated body 12 is resilient and the outer sleeve 34 is elastic, the fabric sleeve 34 and trough 20 are free to laterally expand and contract to conform to the user's forearm. When the user's forearm is placed in the fabric channel above the trough 20, the weight of the forearm will pull the raised edges 24 of the body 12 inwardly slightly or force the raised edges 24 outwardly depending on the size of the forearm, to snugly support and cradle the forearm and retain the cradle 10 under the forearm so that the cradle 10 is moved by and with the forearm as the operator's hand and forearm are moved across a work surface.

As indicated, the outer fabric cover 14 and inner foam body 12 are adapted to conform to the shape of the wrist and forearm and thereby contain the wrist and forearm. The outer fabric cover 14 and inner body 12 provide a cushioned support which elevates and positions the forearm so that the operator's hand extends easily over a computer mouse. The outer cover 14 provides a slippery or low friction surface which glides easily across the work surface. These features minimize the need to use the small muscle groups, tendons and joints in the wrist area. The larger muscle groups can then be relied upon to operate the mouse with little effort and force.

A transverse elastic strap 40 is provided at approximately the middle of the front half of the cradle 10. A transverse velcro strap 42 and a strap ring 44 are provided at approximately the middle of the rear half of the cradle 10. Both ends of the elastic strap 40, one end of the velcro strap 42 and the ring 44 are sewn to the outer cover 14 at the edge seams of the bag 30. Each strap 40, 42 is provided for optional use for retaining the cradle under the forearm. The rear velcro strap 42 is also useful to attach the cradle 10 for example to an arm of a chair to provide an arm cushion for the wrist and forearm.

During mouse operation without use of the support cradle 10 as described, the nerves and tendons in the wrist and forearm are stretched, pressed and rolled against the hard work surface, thereby causing nerve and tendon inflammation and sensitivity. Carpal tunnel, repetitive strain, ulnar nerve inflammation and tendonitis are injuries directly linked to such mouse operation. The cradle 10 protects against such injuries and additionally provides a support cushion for cushioning the inflamed and sensitive nerves and tendons of those mouse operators who have already sustained such injuries.

As will be apparent to persons skilled in the art, various modifications, adaptations and variations of the foregoing specific disclosure can be made without departing from the teachings of the present invention.

I claim:

1. A forearm cradle for a computer operator for supporting the forearm of the operator above a work surface as the operator's hand and forearm are moved across the work surface for operating a computer input device, the support cradle comprising an inner elongated body having a central, longitudinally extending base and a raised longitudinally extending edge extending from an along each side of the base, which together form a contoured top with a longitudinally extending trough, and an outer elongated fabric sleeve extending around and along the elongated body, said fabric sleeve being suspended and supported by and between the raised edges and across the longitudinally extending trough so that the sleeve forms an open, longitudinally extending channel for receiving and supporting the forearm above the work surface and for elevating the operator's hand to extend over the top of a computer input device for operating the input device without normal cocking and hyperextension of the wrist, the elongated body having a bottom surface opposite the trough and the fabric sleeve having a smooth outer surface along at least the bottom surface of the elongated body which is adapted to glide across the work surface so that the support cradle is retained under the forearm, with the forearm received on the open channel and supported by the cradle, and is moved by and with the forearm as the operator's hand and forearm are moved across the work surface.

2. The forearm support cradle as defined in claim 1, wherein the elongated body is made of resilient foam and the bottom surface is generally flat.

3. The forearm support cradle as defined in claim 1, wherein the fabric sleeve is an elastic fabric sleeve.

4. The forearm support cradle as defined in claim 3, wherein the elongated body is made of resilient foam and the elongated fabric sleeve is stretched around the elongated body.

5. The forearm support cradle as defined in claim 1 wherein the fabric sleeve is an elastic fabric sleeve stretched around the elongated body and wherein the elongated body is made of a resilient material providing a support cushion for the forearm and formable within the elastic sleeve to shape the trough to conform to the forearm of the operator.

6. The forearm support cradle as defined in claim 1, wherein the trough of the elongated body alone has a generally constant transverse shape.

7. The forearm support cradle as defined in claim 1 wherein the channel is enlarged at one longitudinal end of the support cradle to receive and support, at least in part, the wrist of the operator.

8. The forearm support cradle as defined in claim 1 wherein the cradle has at least one transverse strap for the forearm for assisting in retaining the support cradle under the forearm and the forearm within the open channel as the forearm is moved across the work surface.

* * * * *